United States Patent [19]

Fukui

[11] Patent Number: 4,820,310

[45] Date of Patent: Apr. 11, 1989

[54] METHOD OF PRODUCING CHARACTERS, SYMBOLS, PATTERNS ON THERMOPLASTIC RESIN MOLDED ARTICLE BY RESERVE DYEING

[75] Inventor: Kiichiro Fukui, Fuji, Japan

[73] Assignee: Polyplastics Co., Ltd., Osaka, Japan

[21] Appl. No.: 146,535

[22] Filed: Jan. 21, 1988

[30] Foreign Application Priority Data

Jan. 21, 1987 [JP] Japan ..... 62-12117

[51] Int. Cl.[4] ..... B05D 1/32; B41M 1/30

[52] U.S. Cl. ..... 8/456; 8/446; 8/471; 8/512; 400/490

[58] Field of Search ..... 8/448, 446, 456, 471

[56] References Cited

U.S. PATENT DOCUMENTS 4,242,378 12/1980 Arai ..... 427/264
4,265,630 5/1981 Bauerle ..... 8/456
4,271,224 6/1981 Mizuwo et al. ..... 8/471
4,634,607 1/1987 Ernsberger ..... 427/282
4,764,177 8/1988 Sumi et al. ..... 8/471

FOREIGN PATENT DOCUMENTS 107983 5/1984 European Pat. Off. .
1517832 7/1978 United Kingdom .

*Primary Examiner*—A. Lionel Clingman
*Attorney, Agent, or Firm*—Nixon & Vanderhye

[57] ABSTRACT

A method of producing characters, symbols, patterns (hereinafter referred to as "characters, etc.") on a thermoplastic resin molded article is characterized in that in order to produce characters, etc. on the molded article, a dye-impenetrable cover is first applied to that part of the surface of the molded article which corresponds to the characters, etc. to be produced, impregnation dyeing being then affected on the molded article surface including at least the peripheral area of the covered part of the surface by using a sublimative dye, the cover being subsequently removed, whereby the characters, etc. are produced as such.

7 Claims, No Drawings

METHOD OF PRODUCING CHARACTERS, SYMBOLS, PATTERNS ON THERMOPLASTIC RESIN MOLDED ARTICLE BY RESERVE DYEING

INDUSTRIAL FIELD OF APPLICATION

The present invention relates to a novel method of producing characters, symbols, patterns (hereinafter referred to as "characters, etc.").

[PRIOR ART AND ITS PROBLEM]

Thermoplastic resins including, for example, aromatic polyester resins, such as polybutylene terephthalates, and polyacetal resins, have excellent mechanical strength, chemical resistance, frictional wear characteristics, creep properties, fatigue properties, electrical characteristics, and dimensional stability, and also have good molding properties. Therefore, they are widely used in various industrial fields including electrical and electronic components, automotive parts, and other industrial machinery parts. The markets for such resins have been expanding and thus their uses in molded parts formed with characters, etc. have likewise expanded.

Hitherto, several methods for producing characters, etc. on molded articles have been known. One method is such that characters, etc. are coated on a resin surface by offset printing, screen printing, or pad printing. Another method is such that characters, etc. are transferred by hot-stamping. Another method is such that an area representing the characters, etc. is recessed during the process of molding in a die, the recessed area being filled with an ink after molding. However, these methods have deficiencies in respect of wear resistance of the character portion against repeated use, feel (hand) at use, resistance to light, heat, resistance to chemicals, applicability for provision of a large variety of characters and to machine diversification, productivity, and/or ease of work. Recently, therefore, impregnation printing techniques are receiving a good deal of attention. Among such techniques are a method such that characters are printed directly on a molded article by pad printing, screen printing, or the like using a special ink incorporating a sublimative dye, and thereafter the molded article is heat treated so that the sublimative dye in the ink is impregnated into the interior of the molded article for fixation therein (direct method). Another method contemplates that characters are printed on a release paper using such special ink and then the printed release paper is placed on a molded article and applied thereon by heat so that the sublimative dye in the ink is impregnated into the interior of the molded article for fixation therein (heat transfer method). According to such impregnation printing method, since the sublimative dye is impregnated into the resin and retained therein, the characters,etc. are provided with good wear resistance so that they will not fade away even after repeated use, and they have good hand during use. Further, such method has good applicability for provision of a large number of characters and to machine diversification, and offers good productivity. Indeed, the impregnation printing techniques have good advantages over the older methods for provision of characters, etc. Yet, such methods for producing characters, etc. by impregnation printing are not universal. The impregnation of the sublimative dye into the resin is oftentimes disavantageous from an aesthetic point of view. That is, impregnation printing is difficult when an attempt is made to produce characters, etc. with a bright tone dye (white in particular) on a resin of a dark tone (black in particular). In such a situation the color of the substrate resin and the color of the dye intermingle with each other at the character portion or the color of the dye is negated by the color of the substrate resin, it being thus unable to produce "clear tone" characters. Despite the fact that characters, etc. produced in such color combination (particularly, in black for peripheral area and in white for characters), more often than not, are preferred, because they clearly contrast, and thus are more easy to see, reposeful, and are acosthetically pleasing, the impregnation printing techniques cannot meet this requirement.

Thus, development has been strongly desired of a method of producing characters which can retain the advantageous characteristics of the impregnation printing techniques, such as high wear resistance of the character area, good hand during use, and applicability for provision of a large variety of characters, and yet which can provide characters in bright color tone in contrast to a peripheral area in dark color tone (particularly, in a color combination of white for the characters and black for the peripheral area).

[Means for Solving the Problem]

The present invention is directed towards overcoming the foregoing difficulties and thus providing a method of producing characters which can well meet the demands for character printed resin articles.

The method of the invention is characterized in that in order to produce characters, etc. on a thermoplastic resin molded article, a dye impenetrable cover is first applied to that part of the surface of the molded article which corresponds to the characters, etc. to be produced (hereinafter referred to as "characters, etc. portion"), impregnation dyeing being then effected on the molded article surface including at least the peripheral area of the covered part of the surface (hereinafter referred to as "characters, etc. peripheral area") by using a sublimative dye, the cover being subsequently removed whereby the characters, etc. are produced as such. Typically, the method may be called "character reserve dyeing".

The scope of thermoplastic resins useful in the method of character reserve dyeing of the invention is not particularly limited. All such resins which are dyeable alone or in a combination of two or more kinds may be used. Above all, those having a moderate degree of crystallizability and, more particularly, aromatic polyester resins, such as polybutylene terephthalates, and aromatic polyester resins are preferred. Mixture resins comprising any of these resins and a reasonable proportion of any of such other kinds of resins as polyethylene, polypropylene; homopolymer or copolymer of $\alpha$-olefin, and modifications thereof; polyuretane, acrylonitrile-styrene (AS) resin, acrylonitrile-butadiene-styrene (ABS) resin, methyl methacrylate-butadiene-styrene (MBS) resin, ethyleneethylacrylate (EEA) resin, polycarbonate resin, fluorine plastic, and polyamide resin may be used as well.

In the present invention, it is possible to add to such substrate resin any known additive and/or filler according to the intended specific purpose, insofar as such addition is not substantially detrimental to the effect of dyeing with a sublimative dye. The additives and/or fillers useful in this connection include, for example, various kinds of stabilizers for anti-oxidation, weathering, and other purposes, lubricants, plasticizers, nucleating agents, parting agents, anti-static agents, and surface active agents; and/or fibrous, lamellar, granular, and powdery materials, such as glass fiber, potassium titanate, glass flake, glass bead, mica, talc, wollastonite, calcium carbonate, titanium carbonate, alumina, boron nitride, ceramic, and metallic powder. Further, the resin may be colored with a mixture of dyes and/or pigments. If any of these additives are incorporated into the resin, however, it is desirable that coloration should be limited so as not to hinder the provision of a sufficient post-dyeing color contrast, in consideration of the feature of the character reserve dyeing of the invention that the character portion remains undyed and shows itself in the color of the material thereof while the peripheral area is shown in a color in which it is dyed or in a mixed color of the dye and the material. Generally, it is desirable to apply the method of the invention to a molded article comprised of a non-colored resin or a resin colored in white or in a bright color tone, dyeing the characters, etc. peripheral area with a black dye or a dark color dye of deep shade.

According to the invention, when subjecting a molded article of such thermoplastic resin to character reserve dyeing, a cover is applied to the characters, etc. portion so that said characters, etc. portion is prevented from being dyed in the process of dyeing.

In this conjunction, the cover for the characters, etc. portion and the manner of covering said portion should be such that the characters, etc. portion is accurately covered so as to prevent entry of the dye thereinto and can easily be uncovered after dyeing. For such covering may be mentioned as useful, for example, inks, dyes, pigments, or paints of the type which do not penetrate the particular resin material, and instant lettering or masking tapes. It is particularly preferable to cover with an ink which will not substantially penetrate into a thermoplastic resin by pad printing or otherwise. This way of covering is advantageous in many respects: simple to carry out, adaptable to a large variety of characters, etc., and effective for the covering of fine characters, etc.

A molded article whose characters, etc. portion has been covered is then subjected to dyeing with a sublimative dye. In this stage, a suitable sublimative dye is selected according to the desired color, and if necessary depending upon the color requirements, two or more kinds of sublimative dyes are used in mixture. The dye may be in the form of a composition containing a vehicle, an auxiliary, and the like, for example, an impregnation printing ink.

The reasons why sublimating dyes are used in the method of this invention are: that good and effective penetration into the resin can be achieved; that bright and stable color effect is obtainable; and that the dye is less liable to blur into the characters, etc. portion, bright character formation being thus assured. Production of characters, etc. with such excellent features cannot be achieved by dyeing with general-purpose disperse dyes or the like.

For the purpose of depositing such sublimative dye on the molded article, various techniques can be employed including: brushing method, spray method, immersion method, and printing techniques, such as pad printing. The molded article on which the dye has thus been deposited is then heated, whereby the dye is impregnated into the resin. The dyeing stage has now been completed. It is also possible to carry out this series of operation in a heated dye bath in which the molded article is immersed, which way of operation is advantageous if the molded article is of a complex configuration. Optimum heating conditions are empirically selected in consideration of various factors, such as thermal properties of the substrate resin, type of the dye, and rate of dye penetration. For example, if the substrate resin is a polybutylene terephthalate resin or polyacetal resin, heating at 100°~180° C. (but below the melting point of the resin) for 1~30 min is preferred, but it is understood that applicable heating conditions are not limited to these. The depth of dye penetration is preferably within the range of 3~500μ. If it is less than 3μ, no durable dye effect can be obtained, and if it is greater than 500μ, the dye is more liable to bleed toward the characters, etc. portion, which fact means lack of practical serviceability. Whether the depth of dye penetration is proper or not has a close relation with the width of the characters, etc. to be produced. If the width of the characters is small, dye penetration should be made less deep.

The molded article which has thus been dyed is finally uncovered at its characters, etc. portion. There is no limitation as to how to remove the cover. However, it is preferable to cover the characters, etc. portion with a material which is soluble in a solvent or the like, as already mentioned, and to remove the cover material by dissolving it with a solvent or the like. This way of removing is most efficient and most preferred.

The process of character reserve dyeing according to the invention has now been completed. The dyed article thus obtained may be further dyed in a different color.

[EXAMPLES]

The invention will be explained in further detail with reference to the following examples. It is understood, however, that the invention is not limited by the examples. Examples 1~4 and Comparative Examples 1~6.

Thermoplastic resin compositions, each comprising a polybutylene terephthalate (PBT) resin [Juranex 2000; product of Polyplastics Co., Ltd.] or a polyacetal (POM) resin [Jurakon M90-02; product of Polyplastics Co., Ltd.], and in mixture therewith, 20% by weight of glass fiber, were molded into flat plates (50 mm×70 mm×3 mm) by injection molding. The flat plates were used as test specimens.

Then, each specimen was subjected to character reserve dyeing in the following manner, whereby the characters were produced on the speciment.

The specimen was first degreased by ultrasonic washing in a 1,1,1 -trichloroethane solution and then dried. Nextly, characters were printed by pad printing on the specimen with a water-based resist ink (produced by Juko Kako K.K.). The ink used was of the type which was not substantially penetrable into the resin; it simply remained as deposited on the surface of the specimen. This ink is soluble in 1,1,1-trichloroethane, for example. Then, in order to dye other parts of the specimen than the characters, an ink (black), SMX PBT (Indian ink) F-1/reducer liquid WKLTD=10/1 (product of Toyo Ink Mfg. Co.), was deposited on the entire surface of the specimen, and the specimen was heated at 160° C. for 8 min, whereby the ink (dye) was penetrated into the resin for fixation therein. It is not in this connection that the ink used for the purpose of dyeing was one containing a sublimative dye.

Finally, the surface of the specimen was washed with 1,1,1-trichloroethane, whereby the water-based resist ink covering the character portion was removed and simultaneously the specimen was degreased. Then, the specimen was dried.

The specimens thus passed through the process of character reserve dyeing were evaluated on the following points:

① Appearance (contrast)
Contrast of the character portion to the pheripheral area; color brightness.

② Appearance (ink bleeding, etc.)
Dye bleeding, etc.; brightness of the border area between the character portion and the peripheral area.

③ Heating and moistening test
Appearance (contrast, dye bleed, etc. considered together) after 10-day treatment in a thermo-hygrostat
bath at 80° C., 95% RH.

④ Wear resistance
Appearance after application of 500 g pressure, 10,000 times, with a plastic eraser (contrast, dye bleed, etc. considered together).

The results are shown in Table 1.

The character reserve-dyed test pieces obtained in these examples were almost free of dye bleeding toward the character portion, showing high brightness of the character portion and good contrast, with excellent visual appearance. These features were not impaired to any perceivable extent in the heating and moistening tests, nor in the wear resistance tests, the specimens being thus found as having sufficient service durability.

For purposes of comparison, black colored specimens were used which were individually made of compositions prepared by admixing carbon black into respective resins of Examples 1~3 so that same color effect as in the examples could be obtained. After application of a base coat, each specimen was subjected to printing with a white ink and then given top coating (Comparative Examples 1, 2, 5). Each of these printed specimens showed good appearance well comparable to the Example 1 specimen, but it had a very serious deficiency in that the characters were readily peeled off and removed in wear resistance tests. Moreover, since its printed portion (characters) was raised, it was inferior in respect of hand. As such, the comparative specimens were far from the target of the invention. For further comparison purposes, same resin moldings as those used in Examples 1~3 were dyed with a desperse dye at 85° C. for 50 min. In other respects, they were treated in same way as in Examples 1~3 (Comparative Examples 3, 4, 6). In this case, the character portion was sufficiently durable, but on the other hand the following deficiencies were observed: that the dye bleeded toward the character portion to an appreciable extent; and that variation in the color tone of the dyed portion was considerable depending upon the dyeing conditions, thus causing lack of contrast and brightness. These defects became far much greater as a consequence of heating and moistening tests, pointing to the lack of practical serviceability.

The results of these comparative examples are also shown in Table 1.

TABLE 1

| | Example | | Comp. Example | | | | Example | | Comp. Example | |
|---|---|---|---|---|---|---|---|---|---|---|
| | 1 | 2 | 1 | 2 | 3 | 4 | 3 | 4 | 5 | 6 |
| Composition | | | | | | | | | | |
| PBT resin (wt %) | 100 | 80 | 100 | 80 | 100 | 80 | — | — | — | — |
| POM resin (wt %) | — | — | — | — | — | — | 100 | 80 | 100 | 100 |
| Glass fiber (wt %) | — | 20 | — | 20 | — | 20 | — | 20 | — | — |
| Resin color | Self color | Self color | Blk colored | Blk colored | Self color | Self color | Self color | Self color | Blk colored | Self color |
| Dye (or ink) color | Black | Black | White (ink) | White (ink) | Black | Black | Black | Black | White (ink) | Black |
| Character producing method *1 | Mthd A | Mthd A | Mthd B | Mthd B | Mthd C | Mthd C | Mthd A | Mthd A | Mthd B | Mthd C |
| Evltn results | | | | | | | | | | |
| Appearance (contrast) *2 | 10 | 10 | 10 | 10 | 7 | 7 | 10 | 10 | 10 | 7 |
| Appearance (dye bleed, etc.) *3 | 10 | 10 | 10 | 10 | 7 | 7 | 9 | 9 | 10 | 6 |
| Appearance after wet heat test *4 | 8 | 8 | 9 | 9 | 4 | 5 | 7~8 | 7 | 9 | 4 |
| Wear resistance *5 | ⊙ | ⊙ | X | X | ⊙ | ⊙ | ⊙ | ⊙ | X | ⊙ |

*1 Method A . . . character reserve dyeing according to the invention (wherein a sublimative dye is used)
Method B . . . black-colored molding colored with white ink by ordinary printing
Method C . . . Disperse dye used; otherwise Method A applicable
*2 Contrast of character portion to peripheral area; color brightness 10 ⟷ 1
excel poor

*3 Dye bleed, etc., color brightness of border area between character portion and peripheral area 10 ⟷ 1
excel poor

*4 Appearance after 240 hr treatment at 80° C., 95% RH (contrast, dye bleed, etc. considered together)

10 ⟷ 1
excel poor

*5 ⊙ ⟷ X
no change chr fade away

EXAMPLES 5~8 AND COMPARATIVE EXAMPLES 7~10

As Table 2 shows, thermoplastic resin compositions comprising same polybutylene terephthalate resin as used in Example 1 and, in mixture therewith, ABS resin, AS resin, or EEA resin, and a thermoplastic resin composition comprising same polyacetal resin as used in Example 3 and, in mixture therewith, a polyurethane resin, were used. Molded specimens were dyed in same way as in Examples 1 and 3.

The character reserve dyed specimens in these Examples showed good appearance well comparable to those obtained in Examples 1 and 3. Nothing abnormal was found with them in wet heat and wear resistance tests.

The test results are shown in Table 2.

For purposes of comparison, black colored moldings formed of compositions comprising those used in Examples 5 and 8 and, in mixture therewith, a pigment were printed with a white ink. As anticipated, they were very much inferior in wear resistance. (Examples 7, 9). Also, tests were carried out by using a disperse dye and in same manner as in Examples 5 and 8. In these tests, considerable dye bleed was found and the dyed portion lacked color brilliance (Comparative Examples 8, 9).

The results were also shown in Table 2.

were almost free of dye bleed; and nothing abnormal was found with them in wet heat and wear resistance tests.

By using as a dyeing agent of other color than black an ink of SMX PBT (indigo) F-1/reducer liquid WKLTD =10/1 (indigo), a product of Toyo Ink Mfg. Co., character reserve dyeing was carried out with same colored specimens as above mentioned (Examples 13~16). This ink was also of the type having a sublimative dye content. The color contrast of the dyed portion to the character portion was somewhat lower as a result of color intermingling in the dyed portion (except that no or little contrast lowering was seen in the case of a white colored one), but nothing abnormal was found in other respects, it being thus confirmed that the method of the invention being advantageously applicable for practical use.

TABLE 2

| | Example | | | | Comparative Example | | | |
|---|---|---|---|---|---|---|---|---|
| | 5 | 6 | 7 | 8 | 7 | 8 | 9 | 10 |
| Composition | | | | | | | | |
| PBT resin (wt %) | 70 | 70 | 90 | — | 70 | 70 | — | — |
| POM resin (wt %) | — | — | — | 90 | — | — | 90 | 90 |
| ABS resin (wt %) | 30 | — | — | — | 30 | 30 | — | — |
| AS resin (wt %) | — | 30 | — | — | — | — | — | — |
| EEA resin (wt %) | — | — | 10 | — | — | — | — | — |
| Polyurethane resin (wt %) | — | — | — | 10 | — | — | 10 | 10 |
| Resin color | Self color | Self color | Self color | Self color | Blk colored | Self color | Blk colored | Self color |
| Dye (or ink) color | Black | Black | Black | Black | White (ink) | Black | White (ink) | Black |
| Character producing method *1 | Mthd A | Mthd A | Mthd A | Mthd A | Mthd B | Mthd C | Mthd B | Mthd C |
| Evln results | | | | | | | | |
| Appearance (contrast) *2 | 10 | 10 | 10 | 10 | 10 | 7 | 10 | 7 |
| Appearance (dye bleed, etc.) *3 | 10 | 10 | 9 | 9 | 10 | 7 | 10 | 7 |
| Appearance after wet treatment *4 | 9 | 9 | 8~9 | 8 | 9 | 5 | 9 | 4 |
| Wear resistance *5 | ◎ | ◎ | ◎ | ◎ | X | ◎ | X | ◎ |

*1~*5 See Table 1.

EXAMPLES 9~16 AND COMPARATIVE EXAMPLES 12~15

Colored thermplastic resins, white, yellow, red, and green, each comprising same polybutylene terephthalate as used in Example 1 and incorporating a pigment, were used. In other respects, character reserve dyeing was carried out in same way as in Example 1 (Examples 9~12). The post dyeing character color contrast varied depending upon the color of the material resin. Where the white colored material was used, the color contrast was most bright, followed by the yellow colored one. The red and green colored ones were less bright, but The results are shown in Table 3.

For purposes of comparison, same white colored ones as used in Examples 9 and 13 and same red colored ones as used in Examples 11 and 15 were treated by using black and blue disperse dyes and in same way as above mentioned. However, the pieces so treated were found inferior in contrast of the character to the peripheral area and showed considerable dye bleed. These defects were further aggravated by heating and moistening treatment, it being thus found that they were not suitable for practical use.

The results are shown in Table 3.

TABLE 3

| | Example | | | | | | | |
|---|---|---|---|---|---|---|---|---|
| | 9 | 10 | 11 | 12 | 13 | 14 | 15 | 16 |
| Cmpn | | | | | | | | |
| PBT resin (wt %) | 100 | 100 | 100 | 100 | 100 | 100 | 100 | 100 |
| Resin color | Wh colored | Yel colored | Red colored | Grn colored | Wh colored | Yel colored | Red colored | Grn colored |
| Dye (or ink) color | Black | Black | Black | Black | Blue | Blue | Blue | Blue |
| Char prod mthd *1 | Mthd A | Mthd A | Mthd A | Mthd A | Mthd A | Mthd A | Mthd A | Mthd A |
| Evln results | | | | | | | | |
| Appearance (contrast) *2 | 10 | 9 | 8 | 8 | 10 | 9 | 7 | 7 |
| Appearance *3 (dye bleed, etc.) | 10 | 10 | 10 | 10 | 10 | 10 | 10 | 10 |
| Appearance after wet *4 heat treatment | 8~9 | 8~9 | 8 | 8 | 8~9 | 8 | 8 | 8 |
| Wear resistance *5 | ◎ | ◎ | ◎ | ◎ | ◎ | ◎ | ◎ | ◎ |
| | | | | Comparative Example | | | | |
| | | | | (1) | 12 | 13 | 14 | 15 |

TABLE 3-continued

| | | | | | |
|---|---|---|---|---|---|
| Cmpn | | | | | |
| PBT resin (wt %) | 100 | 100 | 100 | 100 | 100 |
| Resin color | Dye(or ink) color | Wh colored | Red colored | Wh colored | Red colored |
| Dye (or ink) color | White (ink) | Black | Black | Blue | Blue |
| Char prod mthd *1 | Mthd B | Mthd C | Mthd C | Mthd C | Mthd C |
| Evln results | | | | | |
| Appearance (contrast) *2 | 10 | 7 | 5 | 7 | 4 |
| Appearance *3 (dye bleed, etc.) | 10 | 7 | 7 | 7 | 7 |
| Appearance after wet *4 heat treatment | 9 | 4 | 4 | 5 | 4 |
| Wear resistance *5 | X | ◎ | ◎ | ◎ | ◎ |

*1~*5 See Table 1.

[Advantages of the Invention]

As is clear from the above given examples, according to the method of character reserve dyeing, it is possible to produce characters very effectively and economically in such condition that the character peripheral area is dark colored (black in particular) and the character portion is light colored (white in particular). A molded article with characters produced thereon in such manner has excellent wear resistance such that the characters will not fade away even after series of repeated use, good hand during use, and bright color contrast. With a number of good features like these, the method of the invention is a novel one which has never been found in the art.

Molded articles with characters produced thereon according to the method of the invention, coupled with various excellent properties of thermoplastic resins, can be advantageously utilized for a wide range of applications. More particularly, where the material thermoplastic resin is a polybutylene terephthalate resin or a polyacetal resin, because of its excellent physical, chemical, and mechanical properties, as well as good slidability and molding properties, and because of the fact as earlier mentioned, it has excellent affinity for dyes suitable for character dyeing, such molded articles can be advantageously used for various industrial applications including auto parts, such as light switch, turn signal switch, and washer switch, electrical and electronic components, such as keys for personal computer, word processor, and typewriter, and many other industrial parts.

What is claimed is:

1. A method of forming color-contrasted indicia on a surface of a molded thermoplastic article, which method comprises the steps of:

(a) covering preselected surface regions of molded thermoplastic article which correspond to indicia to be formed on said surface of said article with a removable covering material which does not substantially penetrate into said molded thermoplastic article yet is impenetrable to sublimative dye;

(b) effecting impregnation dyeing on said molded thermoplastic article surface in regions peripheral to said covered preselected surface regions by bringing said peripheral surface regions into contact with a sublimative dye having a color which contrasts to a color of said molded thermoplastic article, and allowing said sublimative dye to penetrate into the molded thermoplastic article to a desired depth below said peripheral surface regions; and then subsequently (c) removing said covering material so as to expose said preselected surface regions of said molded thermoplastic article, whereby said color-contrasted indicia are formed on said surface of said molded thermoplastic article.

2. A method as in claim 1, wherein step (a) is practiced using an ink which does not substantially penetrate into said molded thermoplastic article yet is impenetrable to sublimative dye.

3. A method as in claim 2, wherein the ink is water-based, and wherein step (c) is practiced by washing said surface of said molded thermoplastic article with a solvent for said ink.

4. A method as in claim 3, wherein said washing of said article surface is practiced using an organic solvent which simultaneously removes said ink and degreases said article surface.

5. A method as in claim 4, wherein said solvent is a 1,1,1-trichloroethane solution.

6. A method as in claim 1 or 2, wherein the molded thermoplastic article is formed of a resin selected from the group consisting of aromatic polyester resins, polybutylene terephthalate resins, and polyacetal resins.

7. A method as in claim 1 or 2, wherein step (b) is practiced so that said sublimative dye penetrates said molded thermoplastic article to a depth of between 3μ and 500μ.

* * * * *

UNITED STATES PATENT AND TRADEMARK OFFICE

CERTIFICATE OF CORRECTION

PATENT NO. : 4,820,310

DATED : April 11, 1989

INVENTOR(S) : Kiichiro FUKUI

It is certified that error appears in the above-identified patent and that said Letters Patent is hereby corrected as shown below:

Column 2, line 11, change "acosthetically" to --aesthetically--;

Column 2, line 56, change "polyuretane" to --polyurethane--;

Column 4, line 49, change "speciment" to --specimens--;

Column 4, line 63, after "(dye)" delete "was";

Column 6, line 4, after "but" delete "it";

Column 6, line 10, after "purposes," insert --the--;

Column 6, line 21, delete "far";

Column 7, line 17, delete "The" and insert --These comparative-- and delete "were" and insert --are--;

Column 8, line 49, delete "The" and insert --These comparative-- and after "are" insert --also--;

UNITED STATES PATENT AND TRADEMARK OFFICE

CERTIFICATE OF CORRECTION

PATENT NO. : 4,820,310

DATED : April 11, 1989

INVENTOR(S) : Kiichiro FUKUI

It is certified that error appears in the above-identified patent and that said Letters Patent is hereby corrected as shown below:

Column 9, line 44, change "switch" to --switches--;
line 45, change "switch" (both occurrences) to --switches--;
line 46, change "computer' to --computers--;
line 47, change "processor" to --processors-- and
change "typewriter" to --typewriters--.

Signed and Sealed this

Twenty-third Day of January, 1990

*Attest:*

JEFFREY M. SAMUELS

*Attesting Officer*

*Acting Commissioner of Patents and Trademarks*